US006759796B2

(12) United States Patent
Klett et al.

(10) Patent No.: US 6,759,796 B2
(45) Date of Patent: Jul. 6, 2004

(54) COMPACT SPARK PLUG AND METHOD FOR ITS PRODUCTION

(75) Inventors: Dittmar Klett, Pleidelsheim (DE); Simon Schmittinger, Renningen (DE); Dietrich Trachte, Leonberg (DE); Walter Benedikt, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 43 days.

(21) Appl. No.: 09/964,834

(22) Filed: Sep. 26, 2001

(65) Prior Publication Data

US 2002/0057044 A1 May 16, 2002

(30) Foreign Application Priority Data

Sep. 26, 2000 (DE) ..... 100 47 498

(51) Int. Cl.[7] ..... H01T 13/02
(52) U.S. Cl. ..... 313/143; 313/144
(58) Field of Search ..... 313/143, 144; 126/169 E

(56) References Cited

U.S. PATENT DOCUMENTS 1,485,275 A * 2/1924 Koerber ..... 174/152 S
1,501,368 A * 7/1924 Powell ..... 313/140
1,691,760 A * 11/1928 Fox ..... 313/125
3,300,672 A * 1/1967 Fisher ..... 313/120
3,594,883 A * 7/1971 Bray ..... 445/7
4,489,596 A * 12/1984 Linder et al. ..... 73/116
4,810,929 A * 3/1989 Strumbos ..... 313/11
4,870,319 A * 9/1989 Benedikt et al. ..... 313/137
4,949,006 A * 8/1990 Oshima et al. ..... 313/144
5,731,654 A * 3/1998 Benedikt et al. ..... 313/131
5,918,571 A * 7/1999 Below ..... 123/169 R
6,097,136 A * 8/2000 Oh ..... 313/141
2002/0079801 A1 * 6/2002 Klett et al. ..... 313/143

* cited by examiner

*Primary Examiner*—Vip Patel
*Assistant Examiner*—Glenn Zimmerman
(74) *Attorney, Agent, or Firm*—Kenyon & Kenyon

(57) ABSTRACT

A spark plug is described having a partially cylindrical insulator element and a housing surrounding the insulator element on the side of a base part. The insulator element and the housing are connected with one another by at least one material bond and/or one friction-lock connection aligned in the radial direction. A compact spark plug can be produced using this type of connection. In particular, the diameter of the spark plug is smaller than the diameter of known spark plugs having the same characteristics.

13 Claims, 3 Drawing Sheets

COMPACT SPARK PLUG AND METHOD FOR ITS PRODUCTION

FIELD OF THE INVENTION

The present invention relates to a spark plug which includes a partially cylindrical insulator element and a housing which surrounds the insulator element. The present invention also relates to a corresponding method of production. The insulator element typically includes a ceramic material. In contrast, the housing is made of metal.

BACKGROUND INFORMATION

Various methods are known for connecting the insulator element and the housing. Basically, these can be divided into hot assembly and cold assembly. In hot assembly, the insulator is inserted into the housing. The insulator is then pretensioned in the axial direction by reshaping an inwardly curved flange on the housing. The final pretension in the axial direction is achieved through a shrink fit process. During the shrink fit process, a shrinkage recess which surrounds the housing circumferentially is inductively heated to approximately 1050° C. by a current pulse. As the shrinkage recess cools, the material in the region of the shrinkage recess shrinks. The housing is thus essentially secured on a projection of the insulator element by axial forces. At the same time, the housing is axially friction-locked between two shoulders of the insulator.

In cold assembly, a talcum powder packet is inserted between the flange, which is not yet curved, and the insulator element. Subsequently, the talcum powder packet is compressed by the reshaping process of the flange. In cold assembly as well, the insulator element must have a projection on which the inwardly curved flange is secured.

The known spark plugs do have connections which have high mechanical strength and are gas-tight, but they require a comparatively costly reshaping process.

SUMMARY OF THE INVENTION

An object of the present invention is the provision of a spark plug having a simple construction and a corresponding method of production, with the spark plug particularly being more compact than spark plugs, produced with typical methods of production, having similar or identical operating characteristics, e.g., with regard to thermal conductivity and with regard to electrical characteristics.

The present invention is based on the consideration that reshaping is only possible if the housing has a significantly larger diameter than the insulator element at the reshaping position. In addition, a peripheral projection of the insulator element in the region of the reshaping position must secure the housing.

In the spark plug according to the present invention, the insulator element and the housing are connected to one another by at least one material bond and/or one friction-lock connection aligned in the radial direction. The material bond is, e.g., a metallic soldered or welded connection and the radial friction-lock is a shrink fit connection.

This connection forms at least a significant portion of the cohesion of the housing and the insulator element. If the material bond and/or the friction-lock connection aligned in the radial direction absorb a part, e.g., approximately half, of the forces which act between housing and insulator element, reshaping can be reduced or even avoided completely, because the cohesion of insulator element and housing is achieved in another way. In addition, the peripheral projection on the insulator element can be designed smaller or even be dispensed with completely. If the other properties are unchanged, the spark plugs according to the present invention are more compact than comparable typical spark plugs, because the diameter of the housing selected can be smaller. Spark plugs according to the present invention have smaller internal thread diameters and smaller screw-in devices than known spark plugs having the same thermal value. For example, the outer diameter of the internal thread can be reduced from M14 to M12. Spark plugs produced until now with M8 threads can now be produced with M6 threads.

In a refinement of the spark plug according to the present invention, the diameter of the insulator core remains approximately the same or increases as the distance to the free end of the base part of the insulator (referred to in short in the following as base part) increases in the entire region surrounded by the housing. For example, the insulator core tapers in a stepped shape toward the free end of the base part. In other words, the insulator core does not have a projection in the region of the housing used to secure the housing and is therefore more compact than comparable known insulator elements.

In a subsequent refinement, the inner diameter of the housing in the region of the connection remains approximately the same or increases as the distance to the free end of the base part increases. In other words, the housing no longer has an edge which is curved inward. This allows the use of a housing with a smaller diameter, because reshaping of the edge is no longer necessary.

In a subsequent refinement, the diameter of the insulator element at the end further from the base part in the region adjoining the region surrounded by the housing is approximately equal to the largest diameter of the insulator core in the surrounded region. The insulator element is preferably cylindrical both inside a section of the housing and outside the housing, i.e., it has a uniform diameter. The fewer the projections and constrictions that are located on the insulator element, the more crack resistant it is.

In a subsequent refinement, the housing has at least one tubular section in which the diameter of the insulator core is only slightly smaller than the inner diameter of the housing lying at the same distance to the free end of the base part. The connection lies along the circumference of the insulator element in the gap between insulator element and housing. In this refinement, the connection has a double function, because it is used both for connecting insulator element and housing and for sealing the combustion chamber in which the spark plug is to be inserted.

The tubular section lies close to the base part and/or further from the base part. If the section is close to the base part, it is subjected to greater mechanical load and higher temperatures. On the other hand, the insulator element is thin near the base part, so that the circumference is smaller than further away from the base part. If the connection also seals the combustion chamber gas-tight, the combustion chamber is enlarged only insignificantly if the connection is near the free end of the base part. If the connection is at a greater distance from the free end of the base part, for example at the end of the housing further from the base part, the mechanical loads and the temperature effect are less. The connection will not be loaded as strongly during operation of the spark plug. If the connection is in multiple zones, the disadvantages of one position can be avoided by the advantages of the other position.

In embodiments, the connection is a soldered connection, e.g., a hard soldered connection, an active soldered connection, a welded connection, and/or an adhesive connection. For the welded connection, the known welding methods are used, e.g., friction welding or gas fusion welding. Reactive adhesives, whose components react during curing, are, for example, used as the adhesive for the adhesive connection. However, hard-setting adhesive materials whose components do not react during curing are, for example, also used.

In an alternative refinement, the housing contains at least one tubular section in which the diameter of the insulator element is slightly larger than the inner diameter of the housing, when the insulator element is not in place, lying at the same distance to the free end of the base part. Therefore, this is a compression connection, for example a longitudinal compression connection or a transverse compression connection. During the production of the transverse compression connection, for example, the housing is heated. Subsequently, the insulator core is inserted into the expanded housing. As the housing cools, it shrinks and tightly surrounds the insulator element.

In a refinement of the spark plug according to the present invention, insulator element and housing are connected with one another using an interlayer which was produced before housing and insulator were connected. The interlayer is produced from a material which is capable of being connected well on one side with the ceramic and on the other side with the metal of the housing. The interlayer can, for example, be formed by a thin sheet steel sleeve. However, interlayers made of other materials, e.g., plastic or glass melt, are also used. The interlayer is applied or attached to the insulator element. Thus, interlayers can be deposited directly on the insulator element. The interlayer is attached to the housing using a material bond and/or a friction-lock connection.

If, in an embodiment, the interlayer also extends into regions which lie outside the connection region, the interlayer can be attached better to the insulator, because the connection surface between the insulator and the interlayer is larger.

In a refinement, there is a gap between the housing and the interlayer in the region of the section lying closer to the base part. In the region of a section lying further away from the base part than this section, the interlayer is connected with the housing. In the section lying further away, the interlayer can also be connected with the insulator. However, in an alternative, there is a gap between interlayer and insulator in the section lying further away. In this refinement, a small peripheral ring of the interlayer is exposed in the gap between the insulator and housing. The ring-shaped section forms a kind of membrane which absorbs mechanical loads.

In refinements of the spark plug, the insulator element includes ceramic. The surface of the ceramic is treated in the region of the connection in such a way that the load capacity of the connection is enhanced. Roughening of the surface and/or applying a metallic topcoat are suitable methods.

DETAILED DESCRIPTION

Figure 1A:
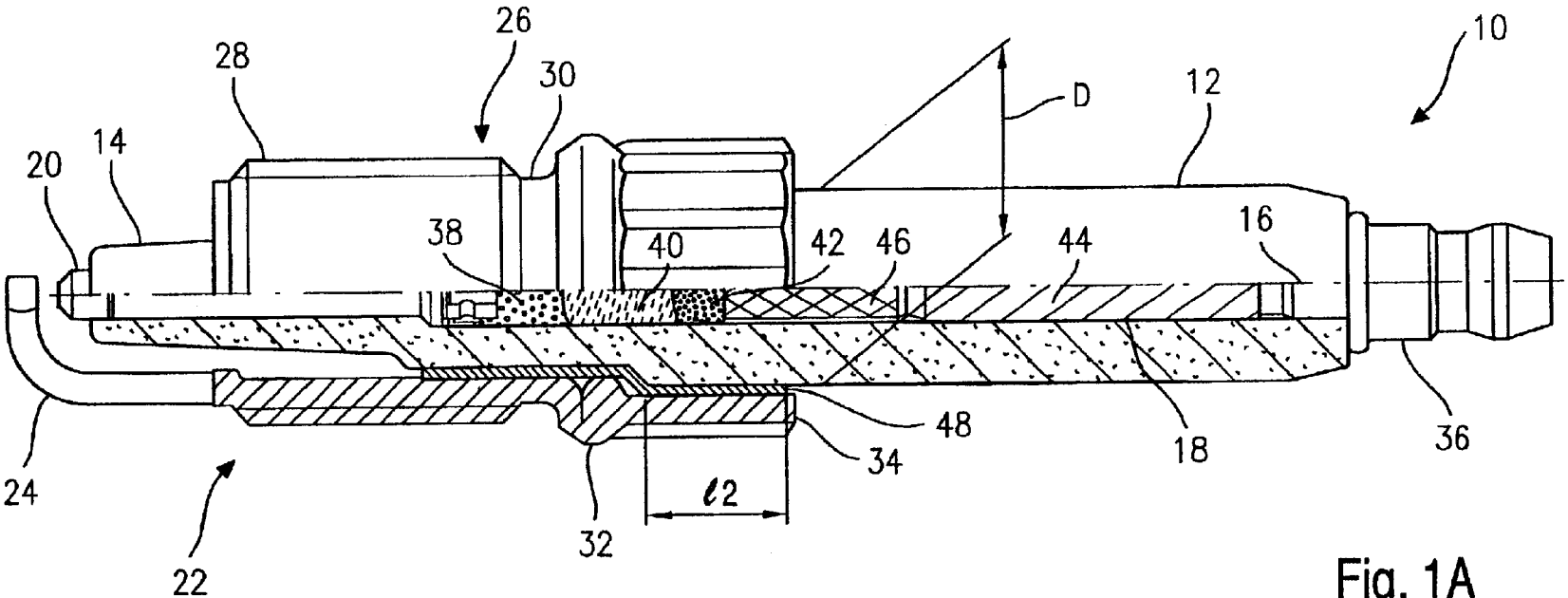
FIG. 1A is a first illustration of a compact spark plug with a damping resistor made of a solidified glass melt.

FIG. 1A shows a compact spark plug 10 in a partial section view. Spark plug 10 includes a cylindrical insulator 12 which tapers at its end toward an insulator base 14. Insulator 12 is penetrated along its longitudinal axis 16 by a through hole 18, whose diameter in the region of a central electrode 20 is somewhat smaller than along the rest of insulator 12. The half of insulator 12 containing insulator base 14 is almost completely surrounded by a housing 22. Viewed from insulator base 14 outward, housing 22 includes, in this sequence, a ground electrode 24, a threaded sleeve 26 having, for example, M14 external thread 28, a peripheral groove 30 for a sealing ring which provides a seal in the conical seal seat, a central part 32, and a double hex insertion nut 34. Housing 22 is screwed into an engine block of the vehicle and is connected with the ground electrode. Insulator 12, which is made of ceramic, insulates housing 22 and central electrode 20 as well as further elements for current conduction located in through hole 18.

In through hole 18 there are, in sequence from central electrode 20 to a terminal stud 36 screwed onto insulator 12 for connection of an ignition cable, an electrically conducting contact 38, a glass melt 40, which forms a damping resistor, an electrically conducting contact 42, and an electrode 44. Electrode 44 tapers toward insulator base 14 and forms a section 46 having a somewhat smaller diameter than the main part of electrode 44.

Housing 22 is connected to insulator 12 by a welded connection 48. Welded connection 48 extends longitudinally up into threaded sleeve 26 from the end of housing 22 further from the base part. Welded connection 48 extends completely around the circumference lying transverse to the longitudinal direction. A gap between insertion nut 34 and insulator 12 is completely closed by welded connection 48. A gap formed between the end of threaded sleeve 26 further from the base part and insulator 12 is also completely closed by welded connection 48.

Figure 1B:
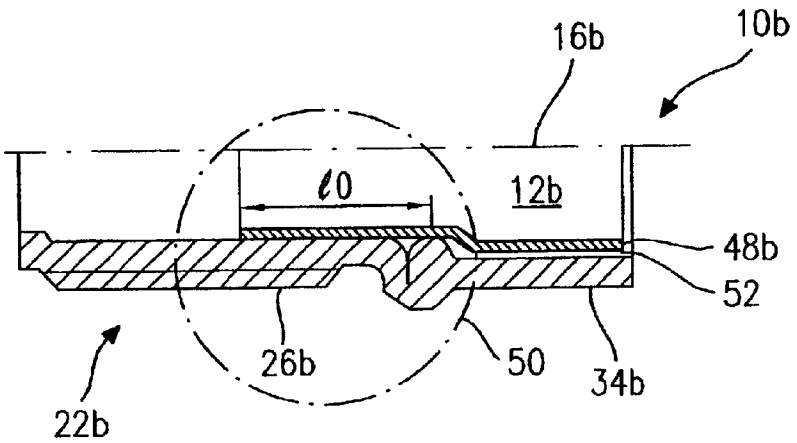
FIG. 1B is a second illustration of the compact spark plug shown in FIG. 1A.

FIG. 1B shows a connection 48*b*, in which a housing 22*b*, constructed like housing 22, of a spark plug 10*b* having an insulator 12*b* is only welded in a region 50 which extends along the half of a threaded sleeve 26*b* further from the base part. Region 50 extends, for example, 10=10 mm in the longitudinal direction, i.e. in the direction of a longitudinal axis 16*b* of insulator 12*b*. Welded connection 48*b* extends along the lateral surface of insulator 12*b* in region 50.

In the region of a insertion nut 34*b* constructed like insertion nut 34, a peripheral gap 52 remains between insulator 12*b* and insertion nut 34*b*. Otherwise, spark plug 10*b* is constructed like spark plug 10.

Due to welded connection 48 or 48*b*, spark plug 10 can be made very compact. The largest diameter D of insulator 12 is, for example, 10.4 mm. Diameter D remains constant in the main part of insulator 12 and therefore essentially determines the overall space for the installation of spark plug 10. Insertion nut 34 is implemented as a double hex nut, e.g., for a width 14 across flats. This is only possible because insulator 12 has no projections in the region of insertion nut 34.

In other exemplary embodiments, an interlayer is used, in place of welded connection 48 or 48*b*, which is welded or soldered onto insulator 12 or 12*b* and onto housing 22 or 22*b*. The welded or soldered connections, respectively, between the interlayer and insulator 12 and between the interlayer and housing 22 are in the region of central part 32 and threaded sleeve 26 and in the region of insertion nut 34. Alternatively, there are connections between the interlayer and insulator 12*b* both in the region of threaded sleeve 26*b* and in the region of insertion nut 34*b*. In the alternative, a connection exists between the interlayer and housing 22*b* only in the region of threaded sleeve 26*b*. A gap remains between the interlayer and insertion nut 34*b* in the region of insertion nut 34*b*.

Figure 2A:
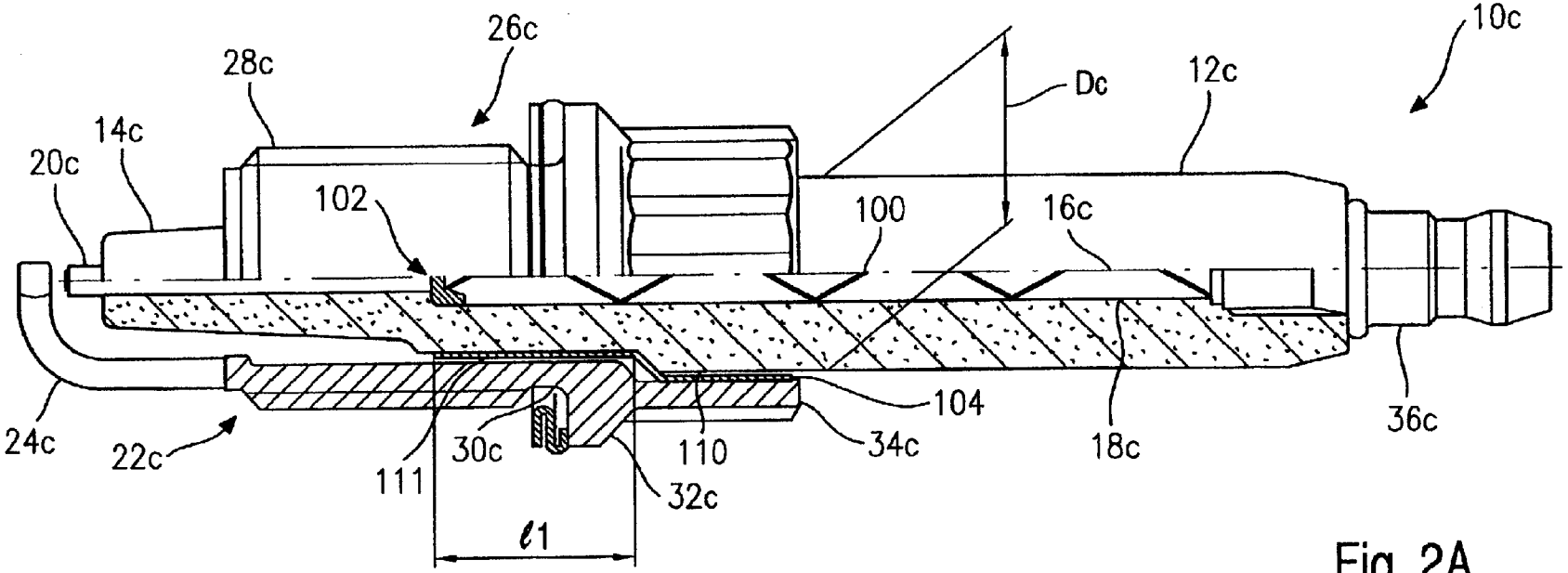
FIG. 2A is a first illustration of a compact spark plug without a damping resistor.

FIG. 2A shows, in a partial section view, a compact spark plug 10*c* which has no damping resistor. Functional elements shown in FIG. 2A which are constructed essentially like those described with reference to FIG. 1A have the same reference numbers in FIG. 2A but are suffixed with the lowercase letter c. This particularly applies to reference numbers 12*c* to 36*c*. Central electrode 20*c* has a diameter in its main part which is smaller than the diameter of central electrode 20. This allows the diameter of through hole 18*c* and outer diameter Dc of insulator 12*c* to be reduced. Central electrode 20*c* is coated with a hard solder paste and then inserted through hole 18*c* into insulator 12*c*. A contact pin 100, made of, for example, a brass alloy, is inserted into through hole 18*c*. When terminal stud 36*c* is screwed in, contact pin 100 is compressed and buckles at multiple buckling positions.

Central electrode 20*c* is secured by contact pin 100. Insulator 12*c* is then transported through a high vacuum furnace at a temperature of a magnitude between 600° C. and 900° C., for example 800° C. The hard solder paste melts and connects central electrode 20*c* firmly and permanently with insulator 12*c*. This connection is also gas-tight. The hard solder paste is, for example, applied in the region of a shoulder 102, at which the inner diameter of through hole 18*c* decreases. Alternatively, central electrode 20*c* can be coated almost completely with hard solder paste, so that central electrode 20*c* and insulator 12*c* are also connected in the region of insulator base 14*c*.

There is an interlayer 104 on insulator 12*c* which is less than, for example, 1mm thick. Interlayer 104 is connected to insulator 12*c* via, for example, a hard soldered connection, in the region of a step 106*d* of insulator 12*c*, which is approximately, e.g., 11=12 mm long. At the end of step 106*d* further from the base part, interlayer 104 conforms to the shape of insulator 12*c*, which widens. In a section 108, however, interlayer 104 forms a tubular section having a larger inner diameter than outer diameter Dc of insulator 12*c*. Thus, there is a gap 110 in the region of section 108 between interlayer 104 and insulator 12*c*. In section 108, interlayer 104 is connected on its outer side with the inner side of insertion nut 34*c*, for example by a soldered or welded connection. In the region of step 106*d*, the outer side of interlayer 104 is not connected with housing 22*c*, so that in this region a gap 111 lies between interlayer 104 and housing 22*c*.

Through the shaping and nature of the attachment of interlayer 104, forces which arise in housing 22*c* as spark plug 10*c* is screwed in cannot be transmitted directly to insulator 12*c*. Interlayer 104 absorbs these forces in the transition region between step 106*d* and section 108.

Figure 2B:
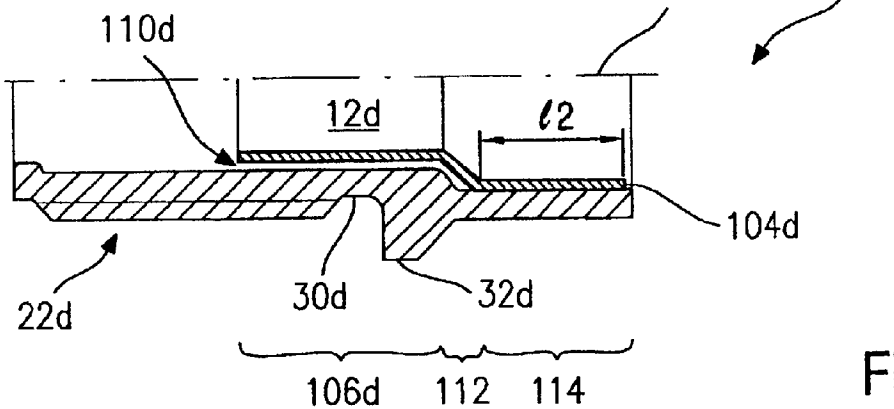
FIG. 2B is a second illustration of the compact spark plug shown in FIG. 2A.

FIG. 2B shows a spark plug 10*d* constructed similarly to spark plug 10*c*. There are differences only in the region of an interlayer 104*d*, which is used in place of interlayer 104. Interlayer 104*d* is connected in the region of a step 106*d* with an insulator 12*d*. In a transition region 112, interlayer 104*d* widens conically in correspondence with the shape of insulator 12*d*. In transition region 112, as well as in an adjacent section 114, the inner side of interlayer 104*d* is also connected with insulator 12*d*, for example with the aid of a soldered or welded connection.

The outer side of interlayer 104*d* is exposed in the region of step 106*d*, so that a gap 110*d* is formed between interlayer 104*d* and housing 22*d*. The outer side of interlayer 104*d* is connected to housing 22*d* in the region of section 114, for example by soldering or welding. The connection has a length of, e.g., 12=8 mm along a longitudinal axis 16*d*.

Mechanical stresses which arise in the region of a groove 30*d* as spark plug 10*d* is screwed in cannot be directly transmitted to insulator 12*d* due to gap 110*d*. The force lines first run into housing 22*d* and only enter insulator core 12*d* in section 114. The forces are, however, already less at this point than in the region of groove 30*d*.

A sealing ring, not shown, is located in the region of groove 30*d* which forms a seal in the flat sealing seat between the engine block and a central part 32*d*. Otherwise, spark plug 10*d* is constructed like spark plug 10*c*.

Figure 3A:
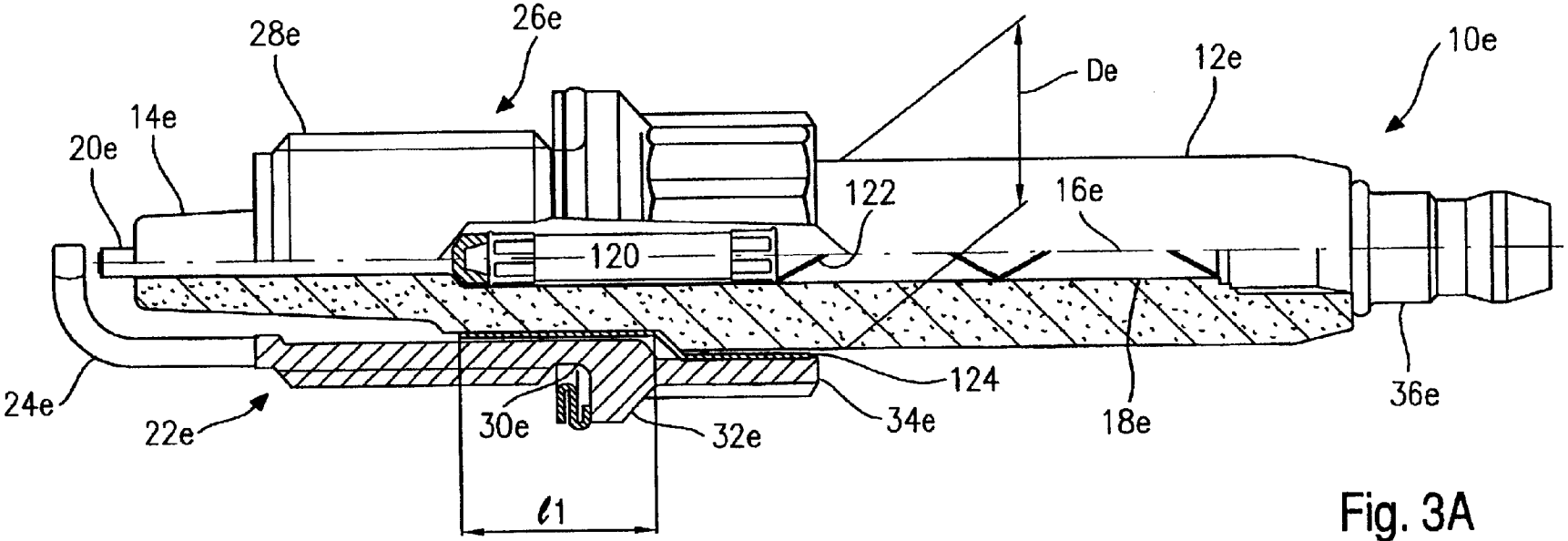
FIG. 3A is a first illustration of a compact spark plug with a nondestructively replaceable damping resistor.

FIG. 3A shows a partial section view of a compact spark plug 10*e* which is constructed similarly to spark plug 10*c*, see FIG. 2A. Elements with reference numbers 12*e* to 36*e* correspond in their design and function to the elements 12*c* to 36*c* which were explained with reference to FIG. 2A.

Central electrode 20*e* is again inserted first into through hole 18*e*. Subsequently, a replaceable damping resistor 120 is inserted, which has a shape resembling a known fuse. Only then is a contact pin 122 inserted, which buckles at multiple buckling positions as terminal stud 36*e* is screwed in. Insulator 12*e*, which was screwed on in this way, is in turn heated to approximately 800° C., with a soldering paste applied to central electrode 20*e* melting and central electrode 20*e* connecting with insulator 12*e*.

An interlayer 124 corresponds to interlayer 104 in its design, function, and type of attachment to insulator 12*e* and housing 22*e*, see FIG. 2A.

Figure 3B:
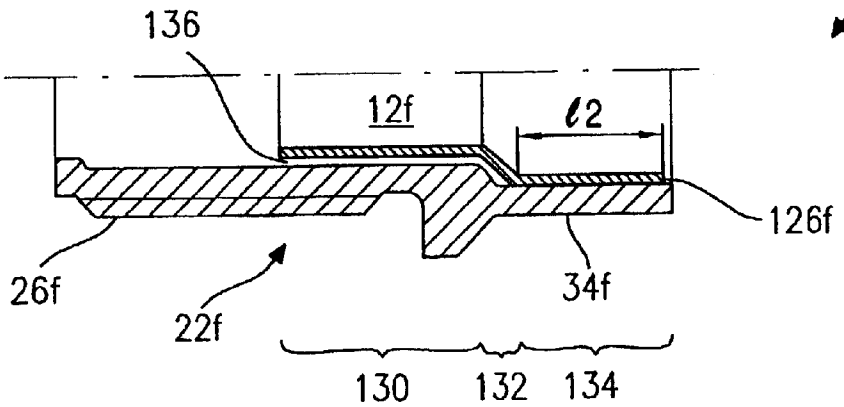
FIG. 3B is a second illustration of the compact spark plug shown in FIG. 3B.

FIG. 3B shows a part of a spark plug 10*f*, which is designed like spark plug 10*e*, see FIG. 3A. An interlayer 126*f* is soldered onto insulator 12*f* of spark plug 10*f* in a section 130. Section 130 lies within threaded sleeve 26*f*. The inner diameter of interlayer 126*f* and the diameter of insulator 12*f* increase uniformly within a transition section 132. In the region of a section 134 lying within insertion nut 34*f*, the inner diameter of the sleeve formed by interlayer 126*f* remains constant. The diameter of insulator 12*f* also remains constant within section 134. In section 134, interlayer 126*f* is soldered to both insulator 12*f* and housing 22*f*. In contrast, in the region of section 130 and in the region of transition section 132, a gap 136 lies between housing 22*f* and insulator 12*f*.

What is claimed is:

1. A spark plug, comprising:

a partially cylindrical insulator element;

a housing enclosing the partially cylindrical insulator element;

a connection including at least one material bond by which the partially cylindrical insulator element and the housing are connected to one another; and an interlayer produced prior to the connection and by which the partially cylindrical insulator element and the housing are connected with one another, wherein:

the interlayer is one of applied and attached to the partially cylindrical insulator element;

the interlayer is attached to the housing using at least one material bond;

a gap is located between the housing and the interlayer in a region of a section lying closer to a base part of the partially cylindrical insulator element; and the interlayer is connected to the housing in a second section further away from the base part.

2. The spark plug according to claim 1, wherein:

the partially cylindrical insulator element includes a base part, and a diameter further from a combustion chamber of the partially cylindrical insulator element at least one of remains approximately equal and increases with an increasing distance from a free end of the base part in an entire region surrounded by the housing.

3. The spark plug according to claim 1, wherein:

the partially cylindrical insulator element include a base part, and an inner diameter of the housing in a region of the connection at least one of remains the same and increases with an increasing distance from a free end of the base part.

4. The spark plug according to claim 1, wherein:

the partially cylindrical insulator element includes a base part, and a diameter of the partially cylindrical insulator element in a region on a side further from the base part adjoining a region surrounded by the housing is approximately equal to a largest diameter of the partially cylindrical insulator element in a region surrounded by the housing.

5. The spark plug according to claim 1, wherein:

the partially cylindrical insulator element include a base part, the housing includes at least one tubular section in which a diameter of the partially cylindrical insulator element is only slightly smaller than an inner diameter of the housing at the same distance to a free end of the base part, and a connection along a circumference of the partially cylindrical insulator element close a gap between the partially cylindrical insulator element and the housing.

6. The spark plug according to claim 5, further comprising at least one of:

first tubular section arranged near a free end of the bass part; and a second tubular section arranged further away from the base part.

7. The spark plug according to claim 1, wherein:

the connection includes at least one of soldered connection, a welded connection, and an adhesive connection.

8. The spark plug according to claim 1, wherein:

the housing includes at least one tubular section, and a diameter of the partially cylindrical insulator element is slightly larger than an inner diameter of the housing, when the partially cylindrical insulator element is not in place, at the same distance to a free end of a base part of the partially cylindrical insulator element.

9. The spark plug according to claim 8, wherein:

the connection further includes a friction-lock connection aligned in a radial direction, and the friction-lock connection is produced by an installation of the partially cylindrical insulator element into the housing, the housing having a higher temperature than the partially cylindrical insulator element at a time of the installation.

10. The spark plug according to claim 1, wherein:

the interlayer extends into regions outside the connection.

11. The spark plug according to claim 1, wherein:

another gap is located between the partially cylindrical insulator element and the interlayer in a region of a third section of the interlayer further away from the base part.

12. The spark plug according to claim 1, wherein:

the partially cylindrical insulator element includes a ceramic, and a surface of the ceramic is treated in a region of the connection such that a load capacity of the connection is increased.

13. The spark plug according to claim 1, wherein:

the connection forms at least a significant portion of a cohesion of the housing and the partially cylindrical insulator element.

* * * * *